United States Patent [19]

Sisson et al.

[11] Patent Number: 4,699,320

[45] **Date of Patent: * Oct. 13, 1987**

[54] SINGLE SOLENOID UNIT INJECTOR

[75] Inventors: Albert E. Sisson, Farmington Hills; Donald J. Lewis, Troy, both of Mich.

[73] Assignee: Allied Corporation, Morris Township, Morris County, N.J.

[ * ] Notice: The portion of the term of this patent subsequent to Aug. 4, 1998 has been disclaimed.

[21] Appl. No.: 894,517

[22] Filed: Aug. 8, 1986

Related U.S. Application Data

[60] Continuation of Ser. No. 559,144, Dec. 7, 1983, abandoned, which is a continuation of Ser. No. 289,005, Jul. 31, 1981, abandoned, which is a division of Ser. No. 6,948, Jan. 25, 1979, Pat. No. 4,281,792.

[51] Int. Cl.[4] ..... F02M 47/02

[52] U.S. Cl. ..... 239/90; 239/91; 239/95

[58] Field of Search ..... 239/88–91, 239/93, 95, 96, 533.3; 123/512, 511

[56] References Cited

U.S. PATENT DOCUMENTS

| | | | |
|---|---|---|---|
| 2,095,889 | 10/1937 | Pokorney | 239/88 X |
| 4,092,964 | 6/1978 | Höfer et al. | 123/511 X |
| 4,235,374 | 11/1980 | Walter et al. | 239/90 |
| 4,281,792 | 8/1981 | Sisson et al. | 239/91 X |

*Primary Examiner*—Andres Kashnikow
*Assistant Examiner*—Daniel R. Edelbrock
*Attorney, Agent, or Firm*—Markell Seitzman; Russel C. Wells

[57] ABSTRACT

A fuel injector (10) is provided for each cylinder of an internal combustion engine, the injector including an electronically operated control valve (146) disposed between supply passage 42 and a timing chamber (98) to control the admission of fuel into and out of the timing chamber. A primary pumping plunger (62) and a secondary plunger (90) are axially spaced within the central bore of the injection body, and a normally closed injection nozzle (14) is situated at one end of the injector body. A mechanical linkage (27, 28, 30) associated with the camshaft of the engine drives the primary pumping plunger (62) against the bias of a main spring (18). The timing chamber (98) is defined between the plungers (62, 90) and a metering chamber (128) is defined between the secondary plunger (90) and the nozzle (14). An electronic control unit (52) responds to engine operating conditions, and delivers a timing and metering signal to the control valve (146) to close the valve and seal the timing chamber for a controlled period of time. The sealed timing chamber forms a hydraulic link, so that the plungers (62, 90) move in concert during the injection and metering phases of the cycle of operation. When the signal from the ECU is terminated, the control valve opens, and breaks the link so that the primary plunger (62) moves independently of the secondary plunger (90) which is biased in a set position by a spring (96) after termination of the control signal. The timing function can be adjusted by the ECU relative to any preselected position of the crankshaft to optimize engine performance, while the metering function is achieved in a proportionate manner relative to the degree of camshaft rotation. A cam (22), having a profiled surface thereon, controls the mechanical linkage, and thus the primary pumping plunger (62), to produce the proportional metering function.

12 Claims, 9 Drawing Figures

STARTING POSITION

INJECTION OPERATION

DUMPING OPERATION

METERING PHASE

SINGLE SOLENOID UNIT INJECTOR

This application is a continuation of application Ser. No. 559,144 filed Dec. 7, 1983, abandoned, which is a continuation of Ser. No. 289,005, filed July 31, 1981, abandoned, which is a division of Ser. No. 006,948 filed Jan. 25, 1979, now U.S. Pat. No. 4,281,792.

BACKGROUND OF THE INVENTION

1. Field of the Invention.

The instant invention relates generally to fuel injection systems, and more particularly to electronically operated control valves for regulating the quantity of fuel dispensed by each injector within a fuel injection system, and for adjusting the timing of the dispensing in dependence upon various engine parameters.

2. Prior Art.

Fuel injectors that are driven mechanically from the crankshaft of an internal combustion engine to deliver fuel into the cylinders of an internal combustion engine are well known; see, for example, U.S. Pat. No. 2,997,994, granted Aug. 29, 1961 to Robert F. Falberg. The movement of the crankshaft is translated into a force that periodically depresses the pump plunger via a cam, cam follower, and rocker arm mechanism. Since the rotation of the crankshaft reflects only engine speed, the frequency of the fuel injection operation was not adjustable with respect to other engine operating conditions. To illustrate, at cranking speeds, at heavy loads, and at maximum speeds, the timing and the metering (quantity) function for the fuel injector did not take into account actual engine operating conditions.

In order to enable adjustments to be made in the timing of the fuel injection phase of the cycle of operation, Falberg proposed that a fluid pressure pump 40 introduce fluid into a follower chamber 37 to elevate a plunger 35 and thus alter the position of push rod 6 which operates plunger member 12 of the fuel injector. By selecting the effective area of the plunger, the elevation thereof advances the plunger member relative to the desired point in the cycle of engine operation. The fluid pressure pump is driven by the internal combustion engine, and a lubricating oil pressure pump is frequently utilized as the fluid pressure pump.

U.S. Pat. No. 3,859,973, granted Jan. 14, 1975 to Alexander Dreisin, discloses a hydraulic timing cylinder 15 that is connected to the lubricating oil system for hydraulically retarding, or advancing, fuel injection for the cranking and the running speeds of an internal combustion engine. The hydraulic timing cylinder is positioned between the cam 3 which is secured to the engine crankshaft and the hydraulic plunger 38. The pressure in the lubricating oil pump 160 is related to the speed of the engine 1, as shown in FIG. 1.

U.S. Pat. No. 3,951,117, granted Apr. 20, 1976 to Julius Perr, discloses a fuel supply system including hydraulic means for automatically adjusting the timing of fuel injection to optimize engine performance. The embodiment of the system shown in FIGS. 1–4 comprises an injection pump 17 including a body 151 having a charge chamber 153 and a timing chamber 154 formed therein. The charge chamber is connected to receive fuel from a first variable pressure fuel supply (such as valve 42, passage 44, and line 182), and the timing chamber is connected to receive fuel from a second variable pressure fuel supply over line 231, while being influenced by pressure modifying devices 222 and 223. The body further includes a passage 191 that leads through a distributor 187 which delivers the fuel sequentially to each injector 15 within a set of injectors.

A timing piston 156 is reciprocably mounted in the body of the injection pump in Perr between the charge and timing chambers, and a plunger 163 is reciprocably mounted in the body for exerting pressure on fuel in the timing chamber. The fuel in the timing chamber forms a hydraulic link between the plunger and the timing piston, and the length of the link may be varied by controlling the quantity of fuel metered into the timing chamber. The quantity of fuel is a function of the pressure of the fuel supplied thereto, the pressure, in turn, being responsive to certain engine operating parameters, such as speed and load. Movement of the plunger 163 in an injection stroke results in movement of the hydraulic link and the timing piston, thereby forcing fuel into the selected combustion chamber. The fuel in the timing chamber is spilled, or vented, at the end of each injection stroke into spill port 177 and spill passage 176. The mechanically driven fuel injector, per se, is shown in FIGS. 14–17.

All of the above-described fuel injection systems employ hydraulic adjustment means to alter the timing of the injection phase of the cycle of operation of a set of injectors mechanically driven from the crankshaft of an internal combustion engine, and the hydraulic means may be responsive to the speed of the engine and/or the load imposed thereon. While the prior art systems functioned satisfactorily in most instances, several operational deficiencies were noted. For example, the hydraulic adjustment means functioned effectively over a relatively narrow range of speeds, and responded rather slowly to changes in the operating parameters of the engine. Also, problems were encountered in sealing the hydraulic adjustment means, for a rotor-distributor pump was utilized to deliver hydraulic fluid to each of the fuel injectors in the set employed within the fuel injection system. In order to provide a hydraulic adjustment means responsive to both speed and/or the load factor, as suggested in the Perr patent, an intricate, multi-component assembly is required, thus leading to high production costs, difficulty in installation and maintenance, and reduced reliability in performance.

The deficiencies of the known fuel injection systems utilizing hydraulic adjustment means to control fuel injection prompted the applicants and other research personnel in the laboratories of the corporate assignee to investigate and develop an electronically operated fuel injector assembly, either an assembly employing one injector for each cylinder of the engine, or a common rail system.

SUMMARY OF THE INVENTION

Thus, with the deficiencies of the known fuel injection systems utilizing hydraulic adjustment means to control the timing of fuel injection clearly in mind, it is an object of the instant invention to employ one electronically operated control valve for each injector utilized within a fuel injection system, whether it be a single injector or a multiplicity of injectors. Each control valve, in response to a signal pulse from an electronic control unit, controls the timing of the injection phase for the injector, and also controls the metering function for the injector, i.e., the quantity of fuel stored for dispensing during the injection phase.

Another significant object of the instant invention is to provide a versatile fuel injection system wherein the timing phase, and the subsequent injection phase, of the cycle of operation can be easily altered in dependence upon any of one or more parameters of engine operation. Such flexibility in the timing phase is in marked contrast to most, if not all, known hydraulic and mechanical adjustment means which are assembled with a preset schedule of operation. Thus, the instant invention lends itself to adaptive control.

Furthermore, it is another object of the instant fuel injection system to utilize existing electronic control units (ECU), such as the ECU described in Ser. No. 945,988, filed Sept. 25, 1978 and incorporated by reference herein, which respond rapidly to several engine parameters in addition to engine speed and load, and generate appropriate signals for the control valve associated with each fuel injector. The signals developed by the ECU are delivered to the control valve in synchronism with angle of rotation of a rotating member of the engine.

Another object of the instant fuel injection system is to respond more quickly to changes in the engine parameters, the inertial effects attributable to the numerous components of the known hydraulic adjustment means being eliminated.

It is a further object of the instant invention to provide a compact fuel injection system to supply precise signals directly to an electronically operated control valve for each fuel injector in the case of unit injectors, common rail injectors, or other types of injection systems. With regard to known fuel injection systems with hydraulic adjustment means, the present invention obviates the prior art problems of (1) sealing hydraulic flow lines, (2) utilizing a pump-distributor for sequentially feeding each injector within an injection system, and (3) flexing of the fluid lines. Also, the present arrangement provides a simple and less costly approach.

Yet another object of the instant invention is to provide a simple, compact, yet reliable, electronically operated control valve that regulates both the timing and the metering functions of a fuel injector. The metering function is proportional to the period that the control valve is retained in its closed condition by an electrical signal from the electronic control unit with respect to the degrees of rotation of a preselected portion of the surface of cam element.

Another object of the present invention is to provide a cam having a profile that contributes to the proportional control of the metering function over an extended phase of the cycle of operation of the injector.

These, and several other objects, are realized in a fuel injector utilizing a primary pumping plunger and a secondary plunger disposed within its central bore. An electronically operated control valve selectively forms a hydraulic link between the plungers so that they move in unison during the injection and metering phases of the cycle of operation. At other times, the secondary plunger is fixed and the primary plunger moves independently thereof. The secondary plunger incorporates a check valve arrangement to accomplish the objects of the invention. A novel method of operating the fuel injector to form a hydraulic link between the plungers is also envisioned as an integral part of the instant invention.

Yet additional objects of the invention, and advantages thereof in relation to known fuel injectors and fuel injection systems, will become readily apparent to the skilled artisan when the specification is construed in harmony with the following drawings in which:

DESCRIPTION OF THE PREFERRED EMBODIMENT OF THE INVENTION

Figure 1:
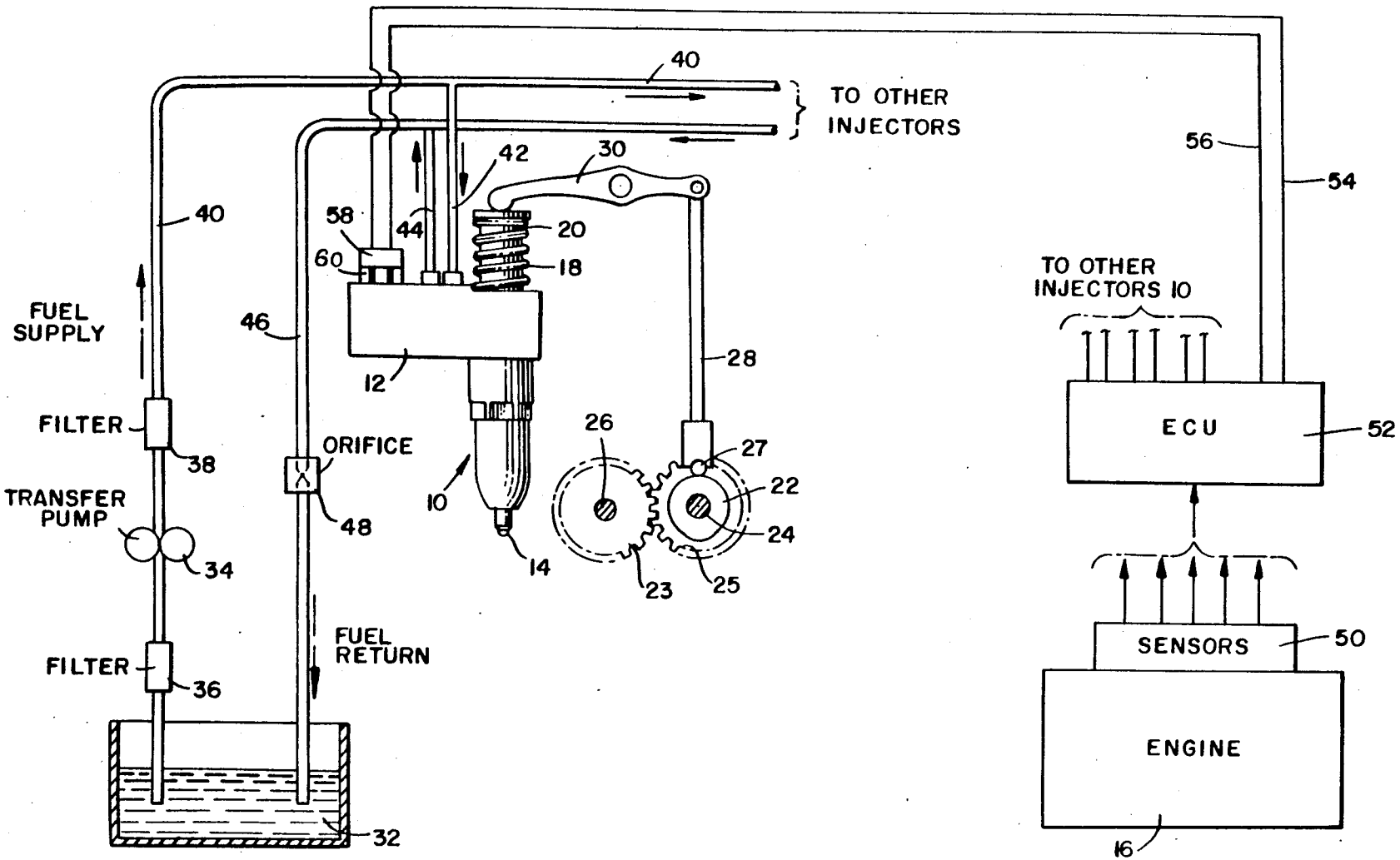
FIG. 1 is a schematic diagram of a fuel injection system configured in accordance with the principles of the instant invention.

Turning now to the drawings, FIG. 1 schematically depicts the major components of a fuel injection system employing an electronically operated control valve for regulating the timing and metering functions of each injector within the system. The system includes a fuel injector 10 that is supported by a support block 12 and is controlled to deliver fuel through a nozzle 14 directly into the combustion chamber (not shown) of an internal combustion engine 16. Although only one injector is shown, it should be noted that a set of identical injectors is employed within the fuel injection system, one injector being provided for each cylinder in the engine. The injector 10 is operated in synchronism with the operation of the engine through the reciprocal actuation of a follower 20, the follower 20 being biased upwardly by a heavy duty spring 18.

A cam 22 is secured to the camshaft 24 of the internal combustion engine 16. Cam 22 rotates at a speed which is a function of engine speed, for the camshaft is driven via meshing gears 23, 25 from the crankshaft 26. The gear ratio of gears 23, 25 may vary from engine to engine depending on various factors, including, inter alia, whether the engine is a two-cycle or four-cycle engine. The crankshaft drives the pistons (not shown) within the combustion chambers of the engine 16 in the usual manner. A roller 27 rides along the profile of the cam, and a push rod 28 and rocker arm 30 translate the movement of the follower into the application of axially directed forces act in opposition to main spring 18 and vary in magnitude with the speed of the engine and the profile of the cam. The cam profile is of particular importance to the operation of the injector and will be discussed more fully in the discussion of FIGS. 8 and 9.

A reservoir 32 serves as a source of supply for the fuel to be dispensed by each injector 10, and fuel is withdrawn from the reservoir by transfer pump 34. Filters 36, 38 remove impurities in the fuel, and distribution conduit 40 introduces the fuel, at supply pressure, to each of the injectors 10. A branch conduit 42 extends between distribution conduit 40 and block 12 and makes fuel, at supply pressure, available for circulation through injector 10. The fuel that is not dispensed into a combustion chamber in the engine is returned to the reservoir 32 via branch return conduit 44 and return conduit 46. A fixed orifice 48 is disposed in return conduit 46 to control rate of return flow into the reservoir. Directional arrows and legends adjacent to the conduits indicate the direction of fuel flow.

The fuel injection system of FIG. 1 responds to several parameters of engine performance. In addition to engine speed, which is reflected in the rate of rotation of the cam 22 secured upon camshaft 24, several sensors 50 are operatively associated with engine 16 to determine, inter alia, engine speed, temperature, manifold absolute pressure, load on the engine, altitude, and air-fuel ratio. The sensors 50 generate electrical signals representative of the measured parameters, and deliver the electrical signals to the electronic control unit, or ECU, 52. The electronic control unit then compares the measured parameters with reference values which may be stored within a memory in the unit, takes into account the rotational speed and angular position of cam 22, and generates a signal to be delivered to each injector. The signal, in turn, governs the timing and metering functions of each injector. Leads 54, 56 and a connector 58 interconnect the electronic control unit 52 and the control valve 146 for the representative injector shown in FIG. 1.

Figure 2:
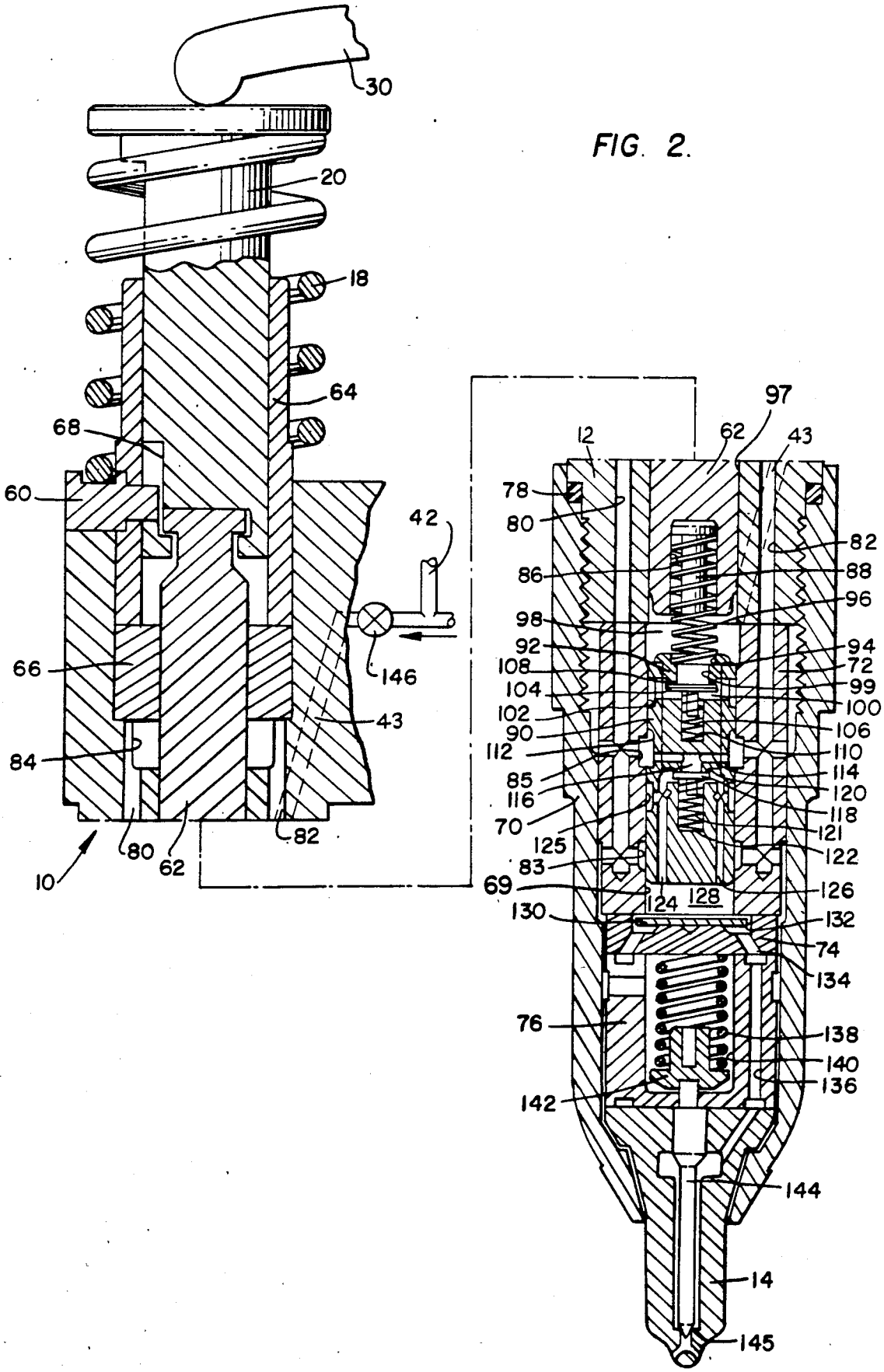
FIG. 2 is a vertical cross-sectional view, on an enlarged scale, of a fuel injector utilized within the system of FIG. 1.

FIG. 2 depicts the components of a representative injector 10. The segment at the left hand side of FIG. 2 fits atop the segment at the right hand side of FIG. 2.

Referring to the upper end of the injector 10, a fragment of the rocker arm 30 is visible bearing against the enlarged upper end of follower 20, and main spring 18 rests on support block 12 and urges the follower 20 upwardly. A primary pumping plunger 62 is joined to the lower end of follower 20, the follower 20 and primary pumping plunger 62 moving as a unitary member. A cylindrical guide 64 insures the axial movement of follower 20, while a seal guide 66 provides a seal and insures the axial movement of primary pumping plunger 62. It is to be understood that block 12 and guides 64, 66 may be formed as an integral unit. A slot 68 in the follower 20 cooperates with stop 60 to prevent the follower 20 and spring 18 from becoming disassembled from the remainder of the injector prior to association with the cam 30 and to limit the downward travel of follower 20.

An internally threaded jacket 70 is screwed into engagement with the mounting block 12, and the interior of the jacket surrounds the distinct segments that comprise the body of the fuel injector 10. Each segment of the body is generally cylindrical in shape, is generally executed in metal, has a central bore and has passages drilled, or otherwise formed therethrough, in alignment with the central bore and the passages of the adjacent segment. Thus, in FIG. 2, fuel injector 10 includes an elongated sleeve 72, a disc-like segment 74, and a spring cage 76 that communicates with nozzle 14. A seal 78 seals the juncture between the block 12 and the threaded jacket 70. Supply passages 80, 82, of which there are two pairs of each, only one each of which are shown, extend through the various segments, and an annular cavity 84 is defined beneath the seal guide 66 and the upper end of the axial passages. The lowermost ends of passages 80, 82 extend radially inwardly to terminate in annulus 83. The passages 80, 82 (a total of four passages arranged around piston 62) also extend radially inwardly to terminate in annulus 85, spaced above annulus 83 in the sleeve of the injector.

A cylindrical recess 86 is located in the lower end of the primary pumping plunger 62, and stud 88 is located within the recess to form a spring retaining member. A secondary plunger 90 is axially movable within the central bore of the sleeve 72, and a valve seat insert 92, with a recess 94 in its upper surface, is situated at the upper end of the secondary plunger. A spring 96 extends between stud 88 and the insert 92 and constantly maintains a downwardly directed biasing force upon the secondary plunger. A variable volume timing chamber 98 is defined between the lower end plunger 62 and the upper end of secondary plunger 90. Secondary plunger 90 slides freely within the bore of sleeve 72 and primary plunger 62 travels within the bore 97 of support block 12.

A passage 99 extends axially through the valve seat insert 92 to communicate with cross-hole passage 100 which opens into annulus 102 formed on the surface of secondary plunger 90. A first check valve 104, preferably in the form of a poppet valve, is normally biased by spring 106 against a valve seat 108 formed in passage 100 to control fluid communication between chamber 98 and passage 100. The spring 106 is seated in a guide cavity 110 in the secondary plunger 90.

An annulus 112 is formed in the outer surface of secondary plunger 90 at approximately the mid-section thereof, annulus 112 communicating with a cross-hole passage 114 and an axial passage 116. A second check valve 118 in the secondary plunger is biased against its valve seat 120 by a spring 121 disposed in a cavity 122 formed in the plunger 90. Valve 118 thus controls communication between passage 116 and inverted L-shaped passages 124, 126, of which there are two each, which extend axially through the lower end of the secondary plunger. The passages open into an annulus 125 formed in the exterior surface of plunger 90. A variable volume metering chamber 128 is defined between the lower end of secondary plunger 90 and the disc-like segment 74.

A disc 130 fits within a recess 132 at the upper end of segment 74, and the disc is of sufficient area to seal off one end of metering chamber 128 to prevent gases in the cylinders in the engine from blowing back into the injector in the event the nozzle 14 fails to seal. The recess 132 opens downwardly into a plurality of passages 134, 136, sets of which are arranged circumferentially around the central axis of injector 10, passage 136 communicating with nozzle 14. The upper end of a needle valve 144 is secured to a spring retaining member 142, and a spring 138 is disposed between element 74 and member 142 to bias valve 144 downwardly against a valve seat 145 to prevent fuel from being dispensed from the nozzle 14. Only when the pressure in passage 136 significantly exceeds the combined forces of the spring biasing pressure and the supply pressure is the needle valve unseated to permit a fine atomized spray of fuel to be issued from nozzle 14.

Branch conduit 42 introduces fuel, at supply pressures of 50–200 psi, into support block 12 through conduit 43 and thence into injector 10. An electronically operated control valve 146 is disposed between conduit 42 and conduit 43 to control both the timing and the metering functions for injector 10 as will be more fully explained hereafter. Branch conduit 43, as suggested by the diagonally extending dotted lines, communicates fuel at supply pressure with timing chamber 98 when the control valve 146 is open.

The functioning of the several components of the fuel injector of FIG. 2 will best be appreciated by reviewing the sequence of operation shown in FIGS. 3–7. However, in order to better portray the sequence of operational events, license has been taken in depicting the various elements of the injector 10. For example, the segments housed within jacket 70 are shown as a unitary member, the guides 64, 66 and disc 130 have been omitted, the follower 20 and the primary pumping piston 62 have been shown as a unitary member, etc.

Figure 3:
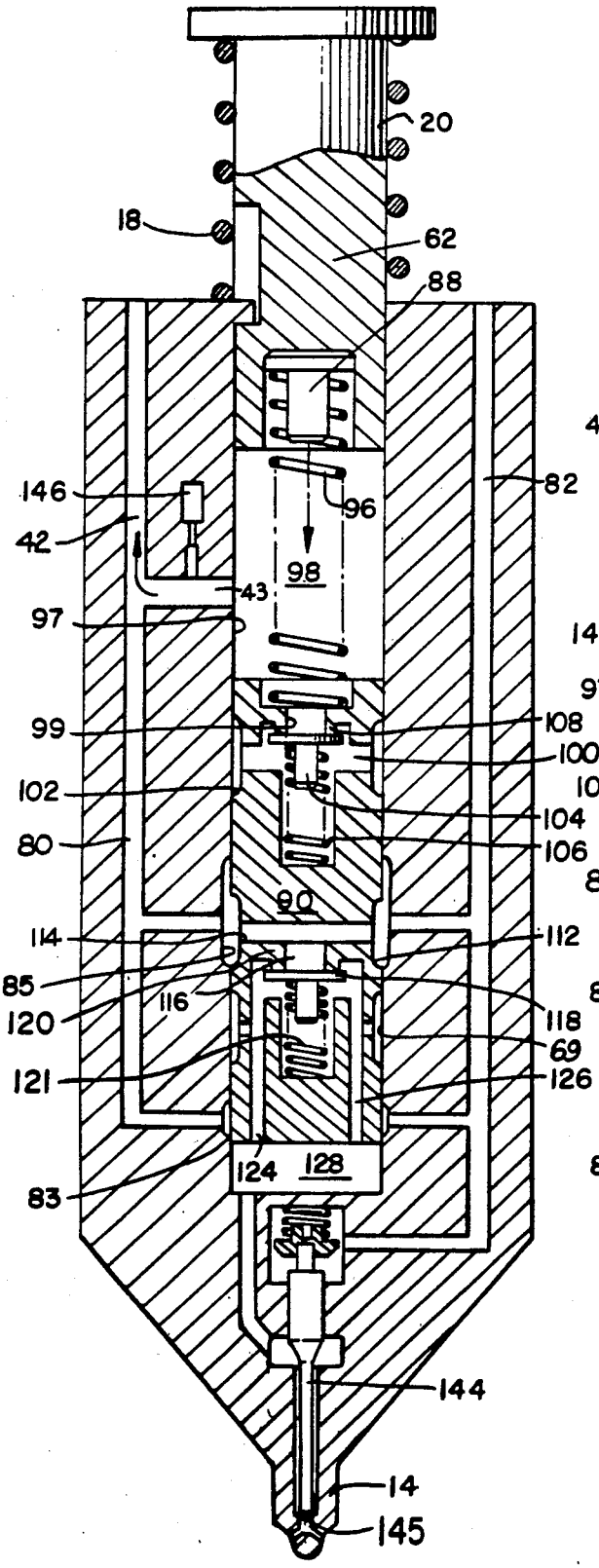
FIGS. 3–7 schematically show the sequence of operational steps for the fuel injector of FIG. 2.

Turning now to FIG. 3, which shows a convenient but arbitrarily selected starting point for the cycle of operation, control valve 146 is shown in its normally opened condition to allow fuel at supply pressure (e.g., 50–200 psi) in the branch conduit 42 access to supply passage 43 and the timing chamber 98. Actually, an equilibrium pressure condition exists (supply pressure) as the primary plunger 62 has ceased its upward motion and is prepared to start its downward motion due to the action of camshaft 24 and cam 22 on plunger 62 as will be seen from a description of FIGS. 8 and 9. The timing chamber 98 and metering chamber 128 previously have been filled with fuel as will be seen from a description of FIGS. 6 and 7. With the control valve 146 open, fuel is free to flow into and out of timing chamber 98. As shown in FIG. 3, check valve 104 is biased against its seat by spring 106 and check valve 118 is biased against its seat by spring 121.

The primary pumping plunger 62 and the secondary plunger 90 sealingly engage the central bores 97, 69, respectively, of the injector, and the spring 96 continuously imparts a downward bias upon plunger 90. A precise amount of fuel is present in metering chamber 128 due to a pior metering operation, to be described in conjunction with the description of FIGS. 6 and 7, and the trapped fuel acts against spring 96. With the control valve 146 opened, timing chamber 98 is in its equilibrium condition, so that when rocker arm 30 forces follower 20 and primary pumping plunger 62 downwardly, at the rate suggested by the arrow beneath plunger 62, fuel is forced out of timing chamber 98 through passages 43, 42. The secondary plunger is unaffected by such movement and remains stationary under the bias of spring 96 and trapped fluid in metering chamber 128. The duration of the period during which valve 146 is maintained in its opened condition relative to a fixed reference is a variable quantity determined by the ECU 52 in response to actual engine conditions and independent of the travel of plunger 62. Thus, the instant at which the valve 146 is closed, and the timing chamber 98 isolated from the supply passage 42, can be adjusted relative to the fixed reference, e.g., the top dead center (TDC) position of the crankshaft 26, over fairly broad limits.

Figure 4:
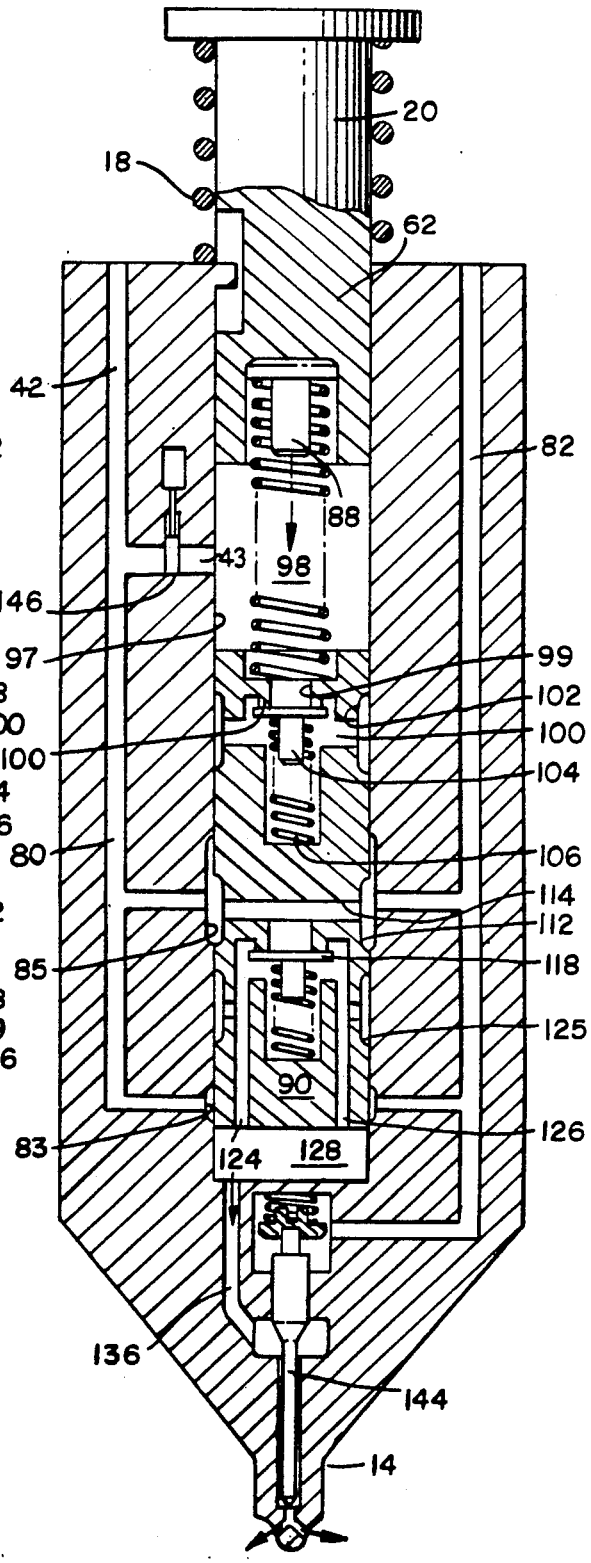

FIG. 4 shows the various components of the fuel injector 10 at the instant that injection starts through nozzle 14 due to the high pressure (several thousand psi) created by the trapped fluid in timing chamber 98 and metering chamber 128. During the downward travel of plunger 62 from the arbitrarily selected starting position of FIG. 3, and a very short period of time before the instant of injection shown in FIG. 4, the valve 146 is closed as described above. With the valve closed, timing chamber 98 is sealed, and the continued downward movement of plunger 62 causes the downward movement of secondary plunger 90 to rapidly increase the pressure of the fuel trapped in chamber 128. The downward movement of the secondary plunger 90 pressurizes the fuel in chamber 128 to a level sufficient to unseat needle valve 144 and permits a fine spray of pressurized fuel to be discharged through the pin holes in nozzle 14.

The second check valve 118 remains seated during the injection phase of the cycle of operation due to the fact that the high pressure below check valve 118 created by the pressure in metering chamber 128, as communicated thereto by passages 124, 126, is greater than the supply pressure in passages 80, 82 and cross-hole 114.

Figure 5:
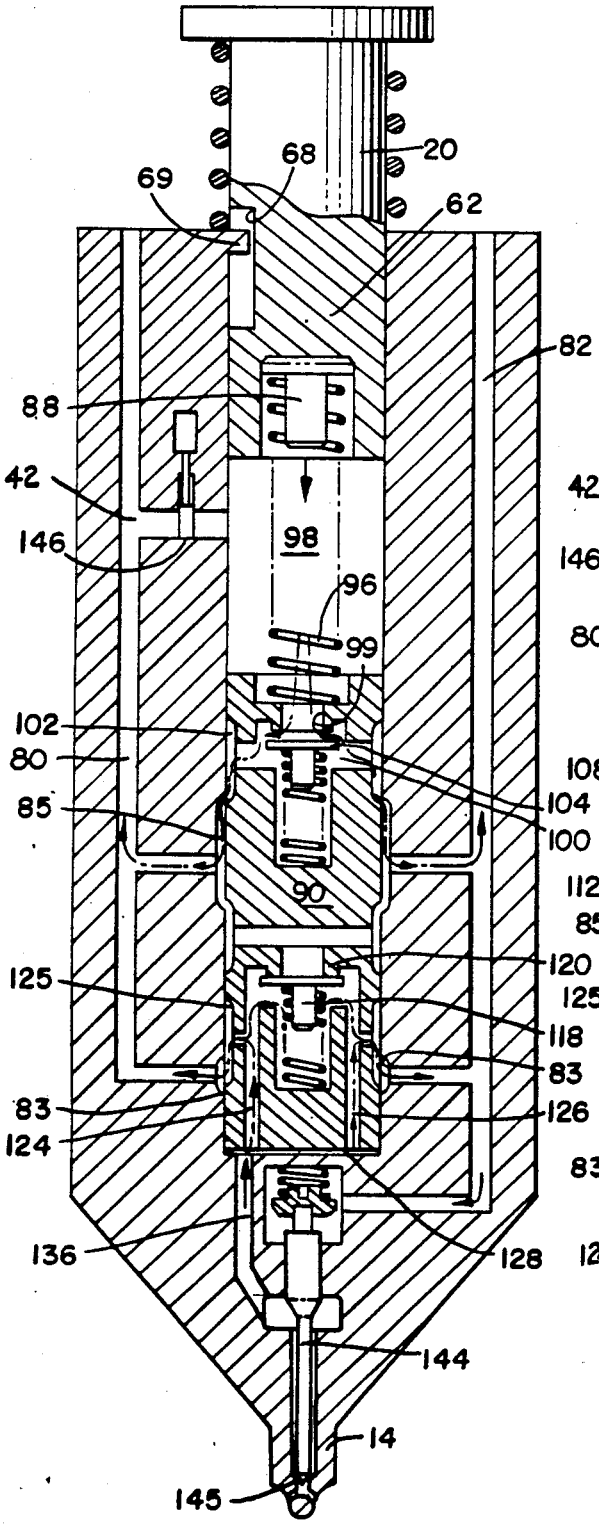

FIG. 5 shows the various components of the fuel injector immediately after the termination of the injection shown in FIG. 4, FIG. 5 illustrating the "dumping" or pressure relieving phase of operation. In this phase the control valve 146 is still closed and the primary pumping plunger 62 is approaching its limit of downward travel, as suggested by the small arrow beneath the plunger. In this phase, the annulus 125 is in fluid communication with annulus 83 thereby communicating the high pressure in passages 124, 126, 136 with the supply pressure in passages 80, 82. As the pressure in passages 124, 126, 136 approaches the supply pressure existing in passages 80, 82, the pressure on the needle valve is insufficient to hold valve 144 open and the needle valve 144 is again seated against seat 145. The pressure build-up in passage 136 and metering chamber 128 is rapidly relieved, so that the undesirable dribble of fuel through the nozzle is prevented.

At the same time, the pressure of the fuel in timing chamber 98, which has been intensified by the downward movement of plunger 62, is relieved to permit the primary plunger 62 to complete its downward travel after the termination of injection and preclude excess pressure on the parts of the injector subject to the pressure in timing chamber 98. More specifically, the annulus 102 is in fluid communication with annulus 85 thereby communicating passage 100 below valve 104 with the supply pressure in passages 80, 82. The pressurized fuel in chamber 98, as compared to supply pressure in passage 100, creates a pressure differential across first check valve 104 to unseat check valve 104. Fuel flows from timing chamber 98, through check valve 104, annulus 102, and annulus 85 back into axial passages 80, 82. Check valve 104 has been provided to check the flow of fuel from passage 80 to timing chamber 98, through annuli 85, 102, just prior to the metering phase of operation. If valve 104 did not seat, fuel flow from passage 80 to timing chamber 98 would preclude the metering to be described below.

The direction of flow of pressurized fuel from both the timing chamber 98 and the metering chamber 128 is indicated by directional arrows. After entering the axial passages, the fuel is returned to reservoir 32 via conduits 44, 46 (FIG. 1).

Figure 6:
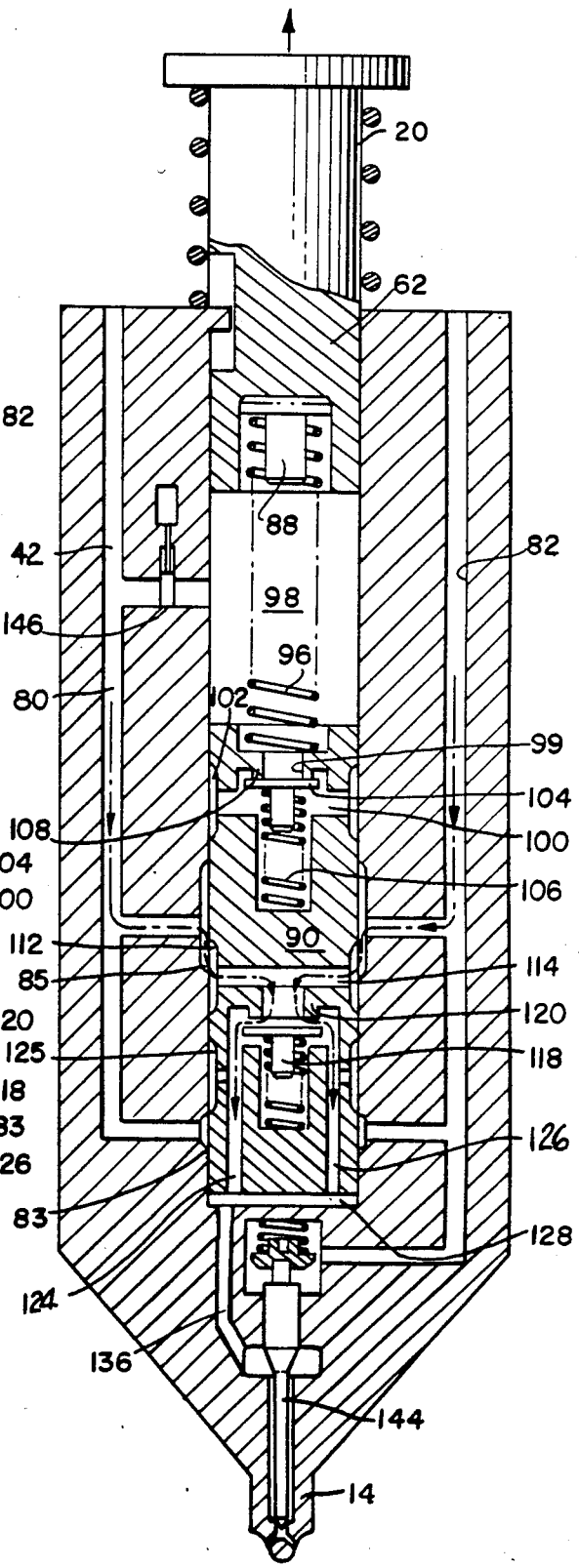

FIG. 6 shows the various components of the fuel injector after the primary pumping plunger 62 has completed its downward travel and has started its upward travel under the urging of spring 18 to create the "metering" phase of operation. The control valve 146 is retained in its closed condition, and annulus 102 is out of communication with annulus 85, thereby sealing timing chamber 98. The fuel in timing chamber 98 is approximately at supply pressure due to the dumping shown in FIG. 5. First check valve 104, which was unseated during the "dumping" phase of the cycle of operation, as shown in FIG. 5 is again held against its seat 108 by spring 106 to prevent communication between chamber 98 and passage 100.

As the primary pumping plunger 62 moves upwardly, as suggested by the arrow atop the head of follower 20, the pressure in timing chamber 98 drops to a pressure level below supply pressure as the volume of chamber 98 increases rapidly. The pressure of the fuel beneath secondry plunger 90 in metering chamber 128 is greater than the combined forces of the fuel in chamber 98 and the biasing force of spring 96. The secondary piston 99 thus follows the primary pumping piston 62 in its ascent because of the net, upwardly directed pressure differential. During this early movement of secondary plunger 90, while annuli 125, 83 are in alignment, fuel flows from passages 80, 82, through passages 124, 126, to metering chamber 128.

As the secondary plunger moves upwardly, the lowermost annulus 125 defined on the plunger 90 moves out of alignment with annulus 83, thereby sealing metering chamber 128 from the annulus 83. The intermediate annulus 112, which opens into cross-hole passage 114, stays in alignment with the lower portion of annulus 85. Consequently, supply pressure in passages 42, 80, 82 is impressed on annulus 85, thence into annulus 112, and passage 114, to the upper portion of second check valve 118. This pressure differential across check valve 118 created by the relatively high supply pressure above check valve 118 as compared to the relatively low pressure in metering chamber 128, unseats check valve 118. Thus, fuel flows into metering chamber 128 through check valve 118, through passages 124, 126, as shown by the arrows in FIG. 6.

The quantity of fuel that flows into metering chamber 128 is proportional to the volumetric displacement of plunger 90 created by the pressure differential across plunger 90. The plunger 90 can only move in concert with plunger 62 while control valve 146 is closed. In summarizing these relationships, it will be appreciated that the quantity of fuel introduced into the metering chamber 128 is proportionally related to the duration or interval, in crankshaft degrees, during which the control valve 146 is held closed after the start of the upward travel of secondary plunger 90. Obviously, when the valve 146 is held closed by a signal from the ECU 52 for the entire interval in crankshaft degrees allocated for metering, the chamber 128 will be filled with the maximum amount of fuel. When the valve 146 is held closed by a signal from the ECU for only half of the interval, defined in degrees of crankshaft rotation, then the metering chamber will be half filled. Other proportional relationships are available in accordance with the fraction of the crankshaft rotational interval selected to hold valve 146 closed. This proportionallity will become more apparent during the discussion of FIGS. 8 and 9.

Figure 7:
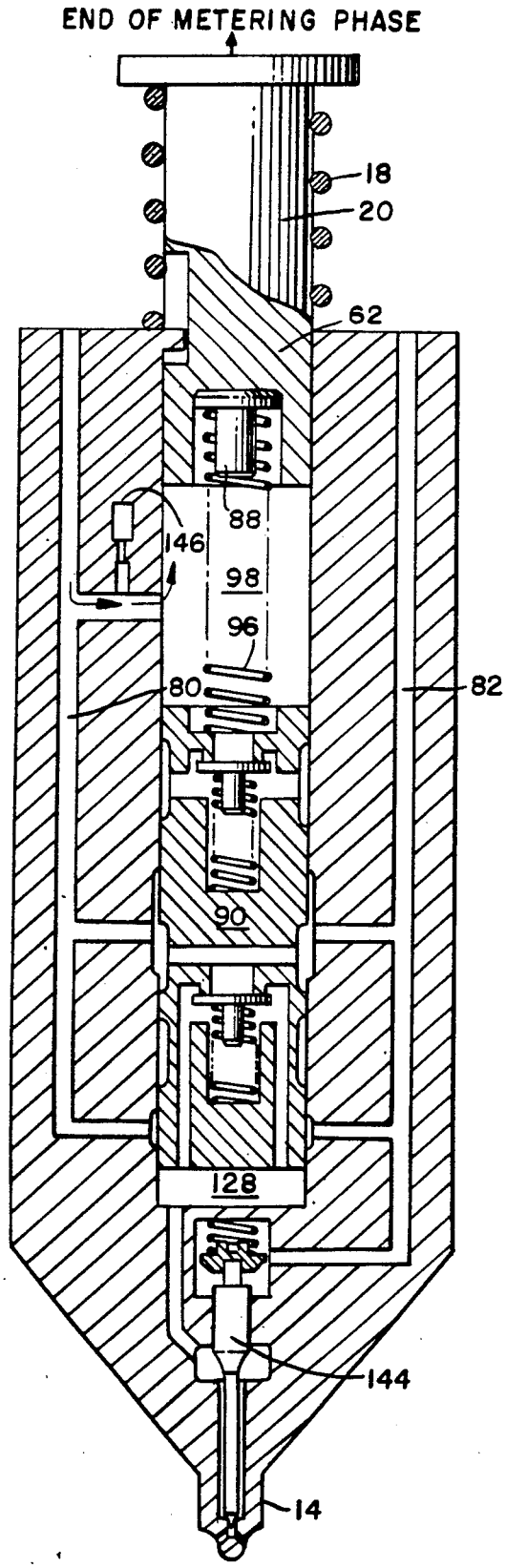

FIG. 7 shows the various components of the fuel injector at the termination of the metering phase of the cycle of operation. The metering phase is terminated by terminating the electrical signal from ECU 52 to the control valve 146, which then returns to its normally opened condition. With valve 146 opened, the fuel at supply pressure in passages 42, 43 and the fuel in timing chamber 98 quickly establish an equilibrium condition at approximately supply pressure level. The pressure differential across plunger 90 is removed and secondary plunger 90 is, in effect, disconnected and cannot follow primary pumping plunger 62 as plunger 62 continues its upward movement. With valve 146 opened, the combined forces of the fuel in timing chamber 98 and spring 96 are greater than the force of the fuel, at supply pressure, retained in metering chamber 128. Therefore, plunger 90 is "locked" or retained in fixed position. The instant at which the signal to valve 146 is terminated is determined by engine operating parameters sensed by the ECU relative to the number of degrees of angular rotation of the camshaft 24 as measured by the crankshaft 26 rotation from the above-described fixed reference, as determined by conventional sensors. Primary pumping plunger 62 continues upwardly, following the cam surface, under the urging of spring 18 independently of secondary plunger 90, as suggested by the arrow atop follower 20 in FIG. 7. When primary pumping plunger 62 reaches its uppermost position, as shown in FIG. 3, then the cycle of operation for the fuel injection can be repeated in the manner shown progressively in FIGS. 3–7.

Figure 9:
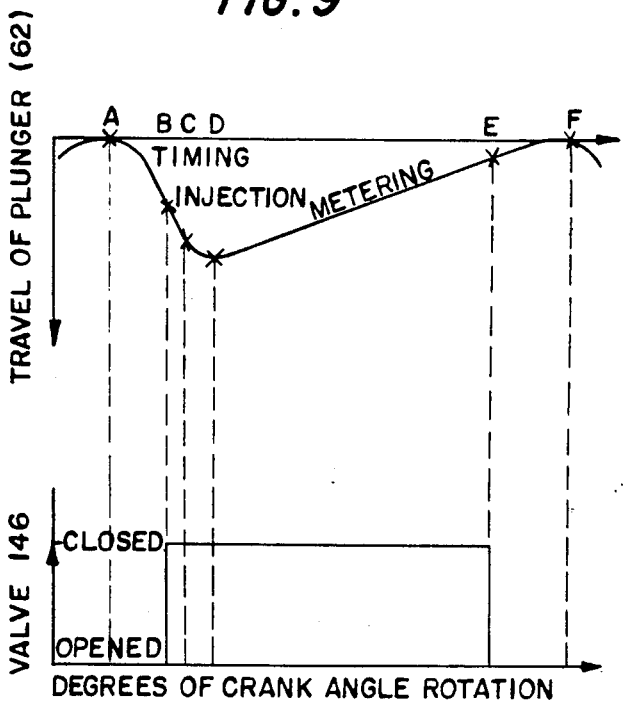
FIG. 9 is a composite schematic representation of the cycle of operation of an injector in the instant fuel injection system; the upper graph traces the movement of the primary plunger versus the rotational movement of the crankshaft, while the lower chart notes the sequence of events versus the rotational movement of the crankshaft.
Figure 8:
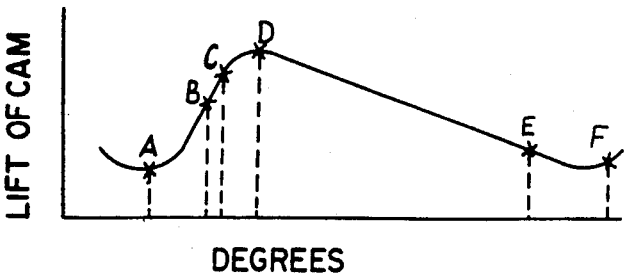
FIG. 8 is a graphical representation of the cam surface utilized to control the movement of certain portions of the injector of the present invention, depicting cam lift relative to degrees of crank angle rotation.

Referring to FIGS. 8 and 9, FIG. 8 illustrates, in graphic form, the profile, or lift, of the cam surface of cam 22 (FIG. 1) relative to the number of degrees of crankshaft rotation, and FIG. 9 illustrates, in graphic form, the vertical motion of primary pumping plunger 62 relative to the same number of degrees of crankshaft rotation and the relationship thereto of the single ECU pulse which initiates injection and terminates metering. Both figures, FIG. 9 particularly, correlate the various phases of injector operation described in conjunction with the description of FIGS. 3 to 7 with degrees of crankshaft rotation. From FIGS. 8 and 9, a very graphic illustration of the proportionallity of the metering phase may be seen. Thus, the termination of the ECU pulse to control valve 146 will be seen to be linearly related to the number of degrees of crankshaft rotation after a preselected reference point (for example, top dead center).

Specifically describing FIG. 8, there is illustrated the lift of the cam, or cam profile surface plotted against the number of degrees of crankshaft rotation, and includes various points (A, B, C, D) along the curve. The curve approaches point A, which is the lowest point of the curve, and will be seen to correspond to the arbitrarily selected starting position described in conjunction with the description of FIG. 3. The curve progresses through the injection phase, between points B and C; the dumping phase, between points C and D; and the metering phase, between points D and E. Point E corresponds to the end of the metering phase and a point F corresponds for the next sequence to point A for the previous sequence.

FIG. 9 is a composite, graphic representation of the operation of one injector 10 in the set of injectors employed in the instant fuel injection system. The upper graph plots the movement, or stroke, of primary pumping plunger 62 along the vertical axis against the degrees of rotational movement of the crankshaft 26; the rotational movement being measured by sensors that provide a signal representative of crankshaft rotation in degrees. The trace of the plunger 62 shows that the plunger instantaneously peaks, then moves downwardly until it reaches a nadir position, and then linearly returns upwardly to the peak position. For a two cycle engine, a complete cycle occurs within 360° of rotational movement of the crankshaft; for a four cycle engine, a complete cycle occurs within 720° of rotational movement of the crankshaft.

The lower graph in FIG. 9 plots the opening and closing of control valve 146 by the ECU, and other events, against the degrees of rotational movement of the crankshaft 26. The leading edge of the signal to control valve 146 causes the valve to change state from its normally opened state to its closed state, and the trailing edge of the signal causes the valve to change state again and return to its normally opened position. It will be noted that a single pulse from the ECU initiates the injection phase and terminates the metering phase, while the internal configuration of the injector (annual, check valves, etc.) terminates the injection phase and initiates the metering phase.

The upper and lower graphs of FIG. 9 may be correlated by following the progression of steps indicated by reference characters A, B, C, D, E and F. It is to be understood that the duration of the period A to D, in degrees, is determined by the sum of injection timing variation and injection duration. It is believed that the determination of the duration of the period A to D is well within the scope of one skilled in the art. The plunger 62 assumes its peak upward position under the bias of main spring 18 at the start of the cycle of operation (FIG. 3). This is point A on the curve and, with the control valve 146 still in its normally opened state, as seen at the bottom of FIG. 9, the plunger 62 starts downwardly under the force of rocker arm 30 pressing against follower 20.

During the course of the downward movement of plunger 62, the ECU 52 delivers a signal to valve 146, and closes the valve as described in conjunction with the description of FIG. 4. Point B on the curve designates the instant at which injection occurs during the timing function due to the closing of the valve 146, while point C indicates when the injection ceases due to the communication of annuli 102, 85 as described in conjunction with the description of FIG. 5. The ECU can be adjusted, either manually or automatically, in accordance with actual engine operating parameters, to shift the timing of the leading edge of the signal relative to the downward movement of the plunger 62. Point B will then shift along the curve to reflect such adjustments. The ability to adjust the instant at which valve 146 is closed to start the injection function assists in more completely burning the fuel discharged into each combustion chamber in the engine 16. Thus, the closure of valve 146 starts the injection phase of the cycle of operation as shown in FIG. 4.

The compression-injection phase of the cycle of operation lasts for the brief interval B-C, the length of which is determined by the quantity of fuel which has been metered into metering chamber 98. During the period B-C the secondary plunger follows the primary plunger downwardly and forces the fuel out of metering chamber 128 and through nozzle 14. The plungers are coupled through the sealed timing chamber 98 which forms a hydraulic link between the two plungers.

Point C on the curve designates the cessation of the injection phase of the cycle of operation and the period between points C-D represents the overtravel and dumping portion of the cycle. At point C, while the control valve 146 remains closed, the passages 124 and 126 in the secondary plunger 90 are in fluid communication with the annuli 125, 83 to communicate metering chamber 128 and passage 136 with the supply pressure in passages 80, 82 and vent, or dump, the pressurized fuel trapped in the metering chamber 128 and the nozzle 14 back into the low pressure of axial passages 80, 82. The venting of the nozzle enables the needle valve to be re-seated and prevent dribble of fuel through the nozzle into the combustion chamber.

Due to the alignment of annuli 102, 85, the pressure below check valve 104 is reduced to supply pressure (below the pressure in timing chamber 98), and the upper check valve 104 is unseated so that the pressure in the timing chamber 98 is reduced, or dumped, to supply pressure, while the primary plunger is decelerating. The relationships that exist at the instant of dumping the pressurized fuel from chamber 128, the nozzle 14, and chamber 98 are shown in FIG. 5.

The downward travel of the primary pumping plunger 62 continues for the interval C-D, or until the plunger 62 reaches its maximum travel. The overtravel of the plunger 62 beyond the termination of injection (point C) and end of dumping (point D) provides sufficient time to equalize the pressures in the injector at supply pressure and to provide the necessary range of timing and injection. When plunger 62 reaches point D, the nadir of travel, and then starts to travel upwardly under the urging of main spring 18, its return trip to its peak upward position occurs over a major portion of the cycle of operation which corresponds to the metering phase (FIGS. 6 and 7).

The curve from point D through points E and F is a linear curve having a constant slope. The linear slope is achieved by a unique profile on the cam 22, which slope is important to the proportional operation of the metering phase of operation. Point E represents the instant that the metering function ceases and corresponds to the termination of the signal from the ECU. The termination of the signal to control valve 146 causes the control valve to return to its normally opened condition, which allows the timing chamber 98 to reach an equilibrium condition with the fuel at supply pressure in passage 42. Spring 96 locks secondary plunger 90 in fixed position in metering chamber 128, and plunger 62 can move independently in response to the application of forces by rocker arm 30 and spring 18. This termination is described in conjunction with the description of FIG. 7.

The metering function can be terminated at any point along the slope D-F; if the metering function is terminated shortly after the primary plunger starts its return trip, then the interval D-E will be shorter than the interval from E-F. The greater the interval D-E, the greater the volume of fuel admitted into metering chamber 128. It is to be noted that the linearity of the portion of the curve between points D and F permits a direct, proportional relationship between the amount of fuel metered and the number of degrees of camshaft rotation. The interval, in degrees of rotation, between points D and F represents the maximum volume of fuel which can be metered, any lesser amount is a direct function (proportional) to the number of degrees of rotation the control valve remains closed after point D. Thus, if point E occurs one-half the number of degrees between D and F, one-half the quantity of fuel is metered.

It should be noted that the metering function can occur, potentially, over more than half the cycle of operation. This "stretching out" of the metering function increases the opportunity to accurately fill the metering chamber 128 to the desired level. As described above, the slope of the curve D-F through the metering function is linearly proportional to the degrees of angular rotation of the crankshaft 26. Thus, if the metering function is assumed to occur, potentially, over 300° of angular rotation for the crankshaft for a two cycle engine, then the termination of the signal from ECU 52 to control valve 146 after 150° of angular rotation, would allow the metering chamber 128 to be half-filled. Alternatively, if the termination of the signal from ECU 52 to control valve 146 occurred after 75° of rotation, metering chamber 128 would be a quarter-filled. Obviously, the metering chamber can be filled to an infinite variety of fractional levels.

It will be readily apparent to the skilled artisan that the foregoing embodiment of this fuel injection system is susceptible of numerous changes without departing from the basic inventive concepts. For example, the primary pumping plunger 62 and follower 20 could be formed as a unitary plunger, and the check valves 104, 112, which are preferably shown as poppet valves, could be disc valves, ball valves, etc. The control valve 146, which is shown as a gate valve responsive to electromagnetic forces, could assume diverse other forms. The profile of cam 22 can also be altered to adjust the duration of the metering function and the rate of return of the primary plunger 62. Also, the spring 96 could be joined to the central bore of the injector, and need not have one end seated in a cavity in the primary pumping plunger; the key consideration is the ability of the spring 96 to always exert a downward force on the secondary plunger and, when necessary, at the end of the metering operation, lock plunger 90 in fixed position. Numerous other modifications and revisions are feasible. Consequently, the appended claims should be liberally construed, and should not be unduly limited their lateral terms.

We claim:

1. An apparatus for an internal combustion engine comprising:

a body having an axially extending bore;

a primary pumping plunger and a secondary plunger positioned within said body for axial movement therein;

a passageway situated at the end of said central bore remote from said primary pumping plunger;

a timing chamber defined in said body between said primary pumping plunger and said secondary plunger;

a metering chamber defined in said body between said secondary plunger and said passageway;

passages in said body for receiving pressurized fuel and transmitting said fuel into said timing chamber and said metering chamber;

means for controlling (1) the timing of the flow of fuel from the metering chamber through the passageway and (2) the quantity of fuel stored in said metering chamber subsequent to said flow of fuel including an electronically operated control valve for controlling the flow of fuel among said passages, said timing chamber and said metering chamber, wherein said electronic control valve controls the admission of fuel at supply pressure into said timing chamber creating a hydraulic link between said primary pumping and secondary plungers to selectively hydraulically connect said primary pumping plunger and said secondary plunger and wherein said electronic control valve is at one of a closed or opened state to create a pressure equilibrium condition in said timing chamber to permit independent movement of said primary pumping plunger relative to said secondary plunger during a portion of the operation of the injector;

spring means situated in said central bore for biasing the secondary plunger toward said passageway;

a first check valve interconnected to control fuel flow between said timing chamber and said passages for periodically eliminating said hydraulic link between said primary pumping and said secondary plungers; and wherein the lower end of said primary pumping plunger has a cavity defined therein and the upper end of said secondary plunger has a recess defined therein, the opposite ends of said spring means being seated in said cavity and said recess.

2. A fuel system for an internal combustion engine having associated therewith a plurality of combustion chambers comprising:

an electrically responsive unit injector associated with each of the combustion chambers, each said injector comprising primary and secondary plungers forming a timing chamber between the two plungers and a metering chamber between the secondary plunger and a fuel discharge port;

a single electrically operated valve which can be opened and closed to regulate the amount of fuel in the timing and metering chambers in each injection cycle;

means associated with the engine and mechanically linked to each one of said injectors for moving each said primary plunger in correspondence with the combustion process within an associated combustion chamber;

means coupled to said moving means for generating signals indicative of engine speed and the motion of each said primary plunger;

means responsive to said signals for generating an electrical signal to close and open each said valve, the presence of said electrical signal closing a particular one of said valves during advancing movement of said primary plunger to close said timing chamber so that the fuel in the closed timing chamber forms a hydraulic link between said primary and secondary plunger, whereby the two plungers move together to inject fuel from said metering chamber through said discharge port during advancing movement of the plungers and to premeter fuel into said metering chamber during retracting movement of the plungers; and the removing of the electrical signal opening said control valve during retracting movement of said primary plunger to open said timing chamber and thereby break said hydraulic link between said primary and secondary plungers so that the primary plunger moves independently of the secondary plunger and thereby terminates the pre-metering of fuel into said metering chamber.

3. The system as defined in claim 2 wherein said metering means comprises a cam, one for each injector, secured to a camshaft, said cam driving a push rod and rocker arm mechanism which translate the rotational motion of said cam to generate axially directed forces upon its corresponding primary plunger.

4. The system as defined in claim 3 wherein said signal generating means includes means for generating a signal indicative of the rotation of each cam.

5. The system as defined in claim 4 wherein said signal generating means includes means for generating signals indicative of the angular position of each cam.

6. The system as defined in claim 5 wherein said responsive means includes an electronic control unit having stored therein reference values indicative of the rotation speed and angular position of each cam and means for generating said electrical signal for each injector control valve in proportion to the measured and reference values of the speed and angular position of each cam.

7. A fuel system for an internal combustion engine having associated therewith a plurality of combustion chambers comprising:

an electrically responsive unit injector associated with each of the combustion chambers, each said injector comprising primary and secondary plungers forming a timing chamber between the two plungers and a metering chamber between the secondary plunger and a fuel discharge port;

a single electrically operated valve which can be opened and closed to regulate the amount of fuel in the timing and metering chambers in each injection cycle;

means associated with the engine and mechanically linked to each one of said injectors for moving each said primary plunger in correspondence with the combustion process within an associated combustion chamber including means for moving said primary plunger during its retracting movement in a linear manner;

means coupled to said moving means for generating signals indicative of engine speed and the motion of each said primary plunger;

means responsive to said signals for generating an electrical signal to close and open each said valve, the presence of said electrical signal closing a particular one of said valves during advancing movement of said primary plunger to close said timing chamber so that the fuel in the closed timing chamber forms a hydraulic link between said primary and secondary plunger, whereby the two plungers move together to inject fuel from said metering chamber through said discharge port during advancing movement of the plungers and to pre-meter fuel into said metering chamber during retracting movement of the plungers; and the removing of the electrical signal opening said control valve during retracting movement of said primary plunger to open said timing chamber and thereby break said hydraulic link between said primary and secondary plungers so that the primary plunger moves independently of the secondary plunger and thereby terminates the pre-metering of fuel into said metering chamber.

8. The system as defined in claim 7 wherein said moving means comprises a cam, one for each injector, secured to a camshaft, said cam driving a push rod and rocker arm mechanism which translate the rotational motion of said cam to generate axially directed forces upon its corresponding primary plunger.

9. The system as defined in claim 8 wherein said signal generating means includes means for generating a signal indicative of the rotation of each cam.

10. The system as defined in claim 9 wherein said signal generating means includes means for generating signals indicative of the angular position of each cam.

11. The system as defined in claim 10 wherein said responsive means includes an electronic control unit having stored therein reference values indicative of the rotation speed and angular position of each cam and means for generating said electrical signal for each injector control valve in proportion to the measured and reference values of the speed and angular position of each cam.

12. The system as defined in claim 8 wherein said cam includes a profiled surface thereon in engagement with said primary plunger which is operative to permit said primary plunger to move linearly during its retracting movement.

* * * * *